United States Patent [19]

Jonsson

[11] 3,992,912

[45] Nov. 23, 1976

[54] ISOSTATIC PRESS

[75] Inventor: Finn L. Jonsson, Ystad, Sweden

[73] Assignee: AB Carbox, Ystad, Sweden

[22] Filed: May 20, 1975

[21] Appl. No.: 579,247

[30] Foreign Application Priority Data

June 10, 1974 Sweden ..... 7407648

[52] U.S. Cl. ..... 72/54

[51] Int. Cl.[2] ..... B21D 26/04

[58] Field of Search ..... 72/56, 54, 57–63, 72/272, 455, 263

[56] References Cited

UNITED STATES PATENTS

| | | | |
|---|---|---|---|
| 3,120,304 | 2/1964 | Pahnke et al. | 72/272 X |
| 3,350,910 | 11/1967 | Muller | 72/272 X |
| 3,383,891 | 5/1968 | Geitz | 72/57 |
| 3,852,986 | 12/1974 | Fuchs, Jr. | 72/272 |

*Primary Examiner*—Milton S. Mehr
*Attorney, Agent, or Firm*—Flynn & Frishauf

[57] ABSTRACT

An isostatic press of the kind in which the workpieces and associated tools are enclosed in a pressure vessel filled with a pressure liquid and closed by a lid. The pressure liquid is pressurized after the pressure vessel has been introduced into a frame adapted to absorb substantially vertical forces. The lid is disposed in the frame and is arranged to be moved substantially vertically in relation to the pressure vessel after said vessel has been introduced into the frame.

6 Claims, 3 Drawing Figures

ISOSTATIC PRESS

This invention relates to an isostatic press of the kind in which the workpieces are enclosed in a pressure vessel filled with pressure fluid and closed by a lid, and the fluid is pressurized after the pressure vessel has been introduced into a frame intended to absorb substantially vertically directed forces.

Known isostatic presses can be divided into two main types, in one of which the pressure vessel is constructed in the form of a cylinder, the two ends of which are adapted to be closed by means of lids adapted to be screwed into the cylinder, said lids having seals. This type is very simple to produce and is suitable for applications requiring only relatively small highpressure vessels. In the case of larger vessels and increasing diameters, the tensile stresses in the screwthreads and cylinder are so great that the lid and bottom should be held in place by external means. An external frame is used for this purpose and is adapted to receive a cylindrical pressure vessel, the lid and bottom of which are adapted to be introduced axially into the cylinder. However, this requires the pressure vessel to be removed from the frame before each pressing operation, to enable new workpieces or the like to be introduced into the vessel, which means that the fluid pipe connected to a fluid duct in the lid must be disconnected once during each press cycle. Apart from the fact that this is a relatively time-consuming process, there are a number of other accompanying problems, since the said connection must satisfy very stringent requirements in respect of sealing, since the pressure is usually very high, for example more than 2000 bars. Inter alia, there is a considerable risk of the fine face of the sealing joint being damaged on repeated disconnections.

The main object of the invention is to provide an isostatic press requiring a shorter time for each press cycle than known presses and eliminating the above disadvantages.

SUMMARY OF THE INVENTION

To this end, according to the invention, the lid is disposed in the said frame and is so arranged that it does not close the said pressure vessel until after the latter has been introduced into the frame. To this end, the press comprises means for carrying out a relative movement substantially vertically between the lid and the pressure vessel after the latter has been introduced into the frame.

In a preferred embodiment, the lid is disposed to be moveable substantially vertically. To allow this movement and produce a power-transmitting connection between the lid and the frame when the fluid in the vessel is pressurized, laterally displaceable spacer elements are used which can be introduced between the said lid and the frame.

Since the lid thus never needs to be displaced horizontally together with the pressure vessel, the operations and risks associated with repeated disconnections of the pressure fluid pipe from the lid are eliminated inter alia.

The special characteristic features of the invention will be apparent from the claims.

BRIEF DESCRIPTIN OF THE DRAWINGS

The invention will be described in detail hereinafter with reference to a preferred embodiment illustrated in the accompanying drawing wherein.

DETAILED DESCRIPTION

Figure 1:
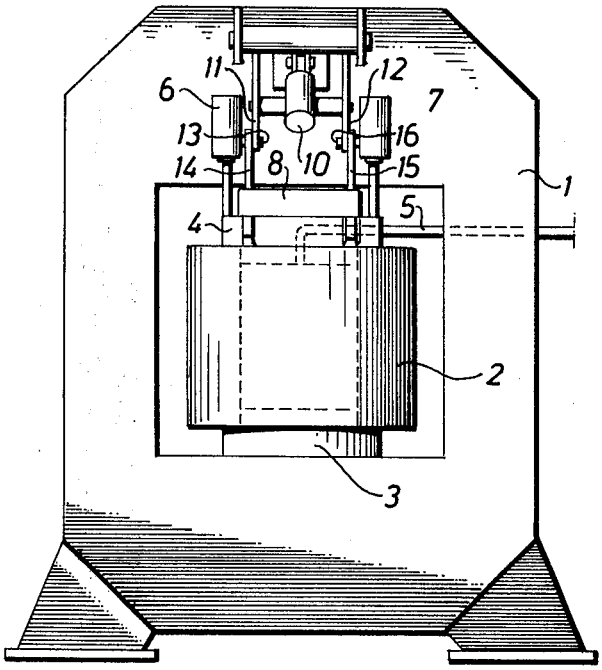
FIG. 1 is a front view of a press according to the invention.

The press shown in the drawing comprises a frame stand 1 into which is introduced a cylindrical high-pressure vessel 2 provided with a bottom closure 3 and a top lid 4. A pressure fluid pipe 5 leads into the top lid 4. The top lid 4 is vertically displaceable by means of two double-acting hydraulic cylinders 6, 7 disposed on each side of the frame. A spacer plate 8 is introduced into the frame 2 between the top lid 4 and the upper yoke of the frame and is laterally displaceable along a track 9 (FIGS. 2 and 3) situated level with the lid. The spacer plate 8 is displaced by means of a hydraulic cylinder 10 actuating two lever arms 11, 12 respectively, the outer ends of which are each provided with a pin 13, 16 respectively. The pins cooperate with grooves formed in panels 14, 15 respectively projecting from the plate.

Figure 2:
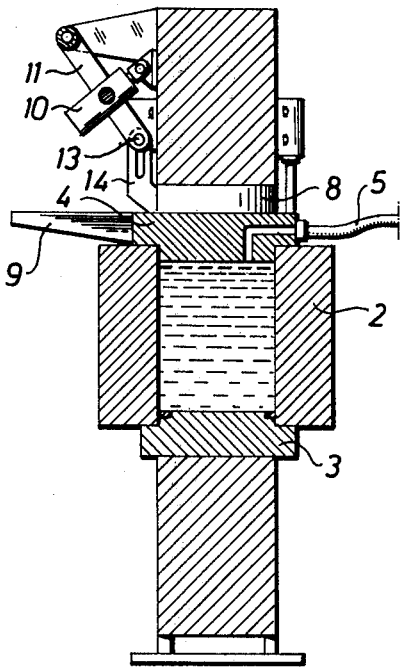
FIG. 2 is a section through the press according to FIG. 1 with the lid cooperating with the pressure vessel in sealing-tight relationship.
Figure 3:
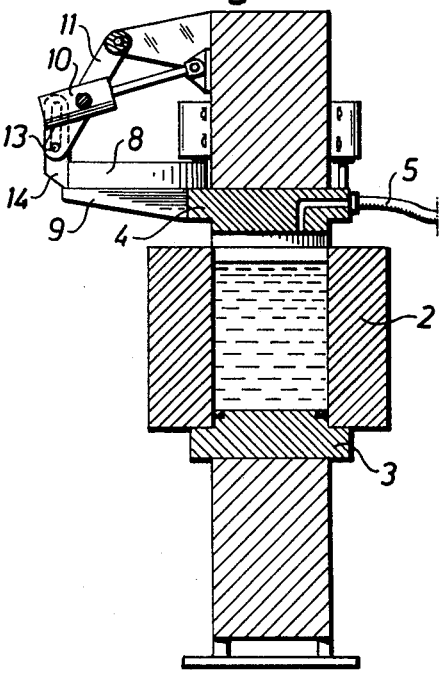
FIG. 3 is a similar view to FIG. 2 but with the pressure vessel open.

In FIGS. 1 and 2 the pressure vessel is shown closed by means of the lid 4, and under these conditions the fluid in the vessel can be pressurized. The forces acting on the vessel bottom closure 3 and top lid 4 will thus be transmitted to the surrounding frame 1 and in the case of the top lid this takes place via the spacer plate 8.

The procedure on charging the pressure vessel is as follows: The pressure source connected to the pressure pipe 5 is disconnected, whereupon the top lid 4 can be pressed back somewhat into the pressure vessel 1 so that the spacer plate 8 is freed. The spacer plate 8 is then withdrawn along the track 9 by means of the hydraulic cylinder 10 and lever arms 11 and 12. When the plate 8 has been completely withdrawn, the lid 4 can be pulled up by means of the hydraulic cylinders provided for this purpose, whereupon the pressure vessel is free to be moved laterally out of the frame so that the workpieces or the like can be changed. The pressure pipe 5 should be somewhat flexible to allow the said vertical displacement of the top lid. However, there is no need to disconnect the fluid pipe from the lid and as indicated hereinbefore this gives substantial advantages over known systems. After the pressure vessel has been charged, it is moved back into the frame, the top lid then first being moved downwardly by means of the associated hydraulic cylinders whereupon the spacer plate 8 is inserted between the top lid and the top yoke of the frame by means of the hydraulic cylinder 10. The fluid in the vessel can then be re-pressurized.

The press according to the invention enables the time taken for one press cycle to be reduced compared with known presses since there is no handling of a released lid and there is no need to disconnect the pressure pipe. The risk of any damage of the seal between the fluid pipe and the lid pipe connection is also eliminated.

In an alternative embodiment, the top lid is fixed in relation to the upper yoke of the frame, the pressure vessel being lifted towards the lid after the vessel has been introduced into the frame, a spacer plate which corresponds to plate 8 being introduced between the bottom closure of the vessel and the lower yoke of the frame.

The above-described embodiments are to be regarded solely as examples, since the invention can be varied in various respects within the scope of the claims, the essential feature being that the vessel top lid is disposed in the frame and a relative movement can be produced between the vessel and the lid after the vessel has been introduced into the frame. In the case of relatively large pressure vessels it may be advantageous, for example, to make the spacer plate 8 in two parts which are withdrawn in diametrically opposite directions each by means of its own withdrawal system.

What is claimed is:

1. An isostatic press comprising:

a pressure vessel for receiving therein a workpiece;

means for filling said pressure vessel with a pressure fluid and for pressurizing same;

a vertically movable lid for sealingly closing said pressure vessel;

a frame for receiving said pressure vessel and lid and including means for absorbing substantially vertically directed forces;

means coupled to said frame and to at least one of said lid and pressure vessel for producing a relative movement substantially vertically between said lid and said pressure vessel after the pressure vessel has been received in said frame; and at least one laterally displaceable spacer element which is located between said lid and said frame before said pressure fluid in said pressure vessel is pressurized.

2. A press according to claim 1, wherein said spacer element comprises at least one laterally movable spacer plate having substantially the same extent in the horizontal plane as said lid.

3. A press according to claim 2, wherein said spacer element comprises a plurality of vertically stacked spacer plates.

4. A press according to claim 1, wherein said means for producing a relative movement comprises means for moving said lid relative to said pressure vessel after the pressure vessel has been received in said frame, said at least one spacer element being located between said lid and said frame before said lid is moved to sealingly close said pressure vessel.

5. A press according to claim 1, comprising a track adjacent said frame for guiding said at least one spacer element, and means for moving said at least one spacer element along said track for location between said lid and frame and for moving said at least one spacer element away from between said lid and frame.

6. A press according to claim 1, wherein said means for filling and pressurizing said pressure vessel is coupled to said lid.

* * * * *